United States Patent [19]

Kumagai

[11] Patent Number: 4,942,698

[45] Date of Patent: Jul. 24, 1990

[54] OPENABLE ROOF AND STRUCTURE THEREWITH

[75] Inventor: Takenori Kumagai, Tokyo, Japan

[73] Assignee: Shimizu Construction Co., Ltd., Tokyo, Japan

[21] Appl. No.: 439,302

[22] Filed: Nov. 21, 1989

[30] Foreign Application Priority Data

Nov. 22, 1988 [JP] Japan ..... 63-295364
Dec. 19, 1988 [JP] Japan ..... 63-319743
Jan. 17, 1989 [JP] Japan ..... 1-8024

[51] Int. Cl.[5] ..... E04H 3/10; E04B 346
[52] U.S. Cl. ..... 52/6; 52/66
[58] Field of Search ..... 52/66, 6

[56] References Cited

U.S. PATENT DOCUMENTS 4,587,775 5/1986 Lewis ..... 52/66
4,727,688 3/1988 Kida ..... 52/66
4,738,057 4/1988 Logan ..... 52/6

FOREIGN PATENT DOCUMENTS 772349 11/1967 Canada ..... 52/66
61-183910 8/1986 Japan .
WO8606123 10/1986 PCT Int'l Appl. .
2199859 7/1988 United Kingdom .

OTHER PUBLICATIONS

Popular Science, Oct. 1958, p. 131.

*Primary Examiner*—David A. Scherbel
*Assistant Examiner*—Deborah McGann Ripley
*Attorney, Agent, or Firm*—Varndell Legal Group

[57] ABSTRACT

An openable roof includes a plurality of fixed roof members and a plurality of movable roof members. Each fixed roof member is a portion of a sphere, with a subsection removed so as to produce an opening. Each movable roof member is the above-mentioned removed subsection with a further subsection removed. The fixed roof members, constitute the lower portion of the openable roof so that a complete opening results from coincidence of the openings. The movable roof members are mounted on the lower portion of the openable roof in such a manner that each movable roof member moves along a track formed along the rim of the opening of the corresponding fixed roof member.

15 Claims, 19 Drawing Sheets

Fig. 1
(PRIOR ART)
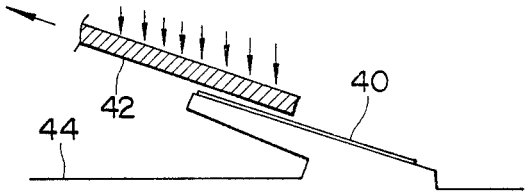
Fig, 9
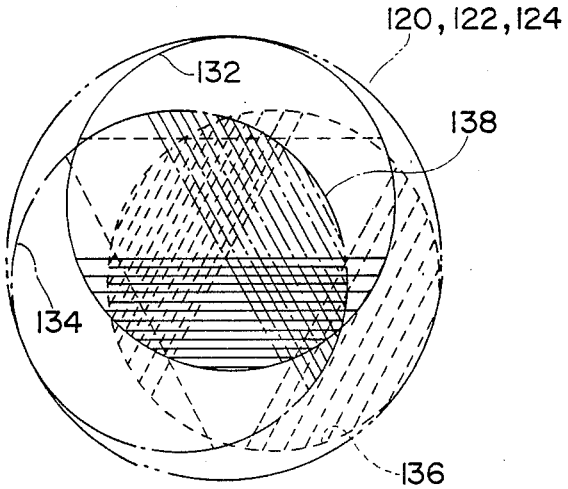

OPENABLE ROOF AND STRUCTURE THEREWITH

BACKGROUND OF THE INVENTION

This invention relates to an openable roof and to a structure incorporating this openable roof.

Openable roofs are highly desirable as they provide sunlight, fresh air, and a sense of freedom when open, while protecting the interior from adverse weather when closed. To this end, various types of openable roofs were previously proposed and developed.

In the operation of the prior art roof, the roof may, for example, simply be moved laterally from the position above the interior area.

FIG. 1 depicts a conventional openable roof comprising a fixed roof member 40 and a movable roof member 42. The movable roof mmeber 42 can slide to a retracted position over the movable member 40, exposing the interior area 44 to the outer environment; or the movable roof member 42 can be extended to protect the interior area 44 from the outer environment.

Another type of conventional openable roof is constituted so as to be pleated like an accordion when retracted.

With the above types of openable roofs, the desired protection from, or opening to, the outer environment can be achieved, however, the following problems exist:

1. If the movable roof member is simply moved laterally, space is required to store the movable roof member on the outside of the building, which results in a waste of space. Furthermore, corresponding points of support of the movable roof member must be moved in synchrony, especially for a roof spanning a great distance.

2. If the construction shown in FIG. 1 is used, the movable roof member 42 can move to a position above the fixed roof member 40 so that space for storing the movable roof member 42 outside the building is not necessary. However, fixed roof member 40 must be reinforced to have enormous rigidity in order to support the movable roof member 42. Furthermore, since the movable roof member 42 is of a cantilever type, it must be reinforced to have enormous rigidity in order to support itself. Therefore, the costs of construction are increased.

3. If the accordionlike openable roof is used, additional space for storing the roof outside the building is not neccessary. However, it is still necessary to provide a storage area, and the like, for containing the folded roof inside or outside the building. In addition, the driving mechanism for moving the movable roof member must be of complicated design to accommodate the roof configuration.

4. The roofs of the prior art cannot be dome-shaped; they must be, for example, of flat shapes when the roofs are closed above the interior areas. Therefore, the possible designs of the roof are limited.

SUMMARY OF THE INVENTION

It is therefore an object of the present invention to provide an openable roof having movable roof members for which a space to contain the movable roof members is effectively disposed within the structure itself, having all the conventional functions of the movable roofs: allowing sunlight and fresh air inside the structure and giving a sense of freedom, while protecting the interior from the effects of adverse weather.

It is another object of the present invention to provide an openable roof which is of excellent rigidity.

It is a further object of the present invention to provide an openable roof having a three-dimensional shape and an excellent design.

According to the present invention, the openable roof member includes a plurality of sets comprised of a fixed roof means and movable roof means.

The fixed roof means is fixedly constructed at prescribed locations. Each of the fixed roof means has an opening substantially opening upwards, and a generaly circular track around the opening. At least one part of each of the fixed roof means substantially intersects a wall of the other fixed roof means in such a manner that the openings partially coincide so as to form a complete opening.

The movable roof means is movably disposed on the fixed roof means. Each of the movable roof means is disposed radially inside the circular tracks formed on the corresponding fixed roof means. Each of the movable roof means has a first arc-shaped edge disposed on the corresponding circular first track. The curvature of the first arc-shaped edge corresponds to the curvature of the circular first track of the fixed roof means so that each of the movable roof means is able to revolve around an axis of the first track of the corresponding fixed roof means so as to participate to open and close the complete opening entirely.

More preferably, the openable roof further includes first connecting means for connecting the movable roof means to the fixed roof means, and a first driving means for driving the movable roof means into motion. Each of the first connecting means is disposed adjacent to the corresponding first track of the fixed roof means and the corresponding first arc-shaped edge of the movable roof means so as to allow the movement of the corresponding movable roof means.

More preferably, eqch fixed roof means includes a section of a sphere, with a subsection removed, so as to produce the opening of a generally circular shape with a generally planar rim, on which is disposed the first track. Furthermore, each of the movable roof means is generally a portion of the subsection of the sphere.

More preferably, the circular openings are inclined to a horizontal plane in such a manner that at least the lowermost portions of the openings coincide when the roof is open.

In one aspect of the present invention, the sets comprised of fixed roof means and movable roof means are generally sections of spheres. The spheres are of slightly different radii and disposed concentrically.

In another aspect of the present invention, each of the movable roof means includes a first movable roof member and a second movable roof member. The first and second movable roof members of the same movable roof means are subsections of the same sphere. Each of the movable roof members has first and second arc-shaped edges. Each of the first movable roof members is disposed at the first arc-shaped edge thereof movably on the first track of the corresponding fixed roof member. Each of the first movable roof members has a second arc-shaped track adjacent to and along the second arc-shaped edge thereof. Each of the second movable roof members is disposed at the first arc-shaped edge thereof movably on the second track of the corresponding first movable roof member. The openable roof preferably includees a plurality of support tracks on which moves the second movable roof member transferred from the corresponding second track. Each of the support tracks is arc-shaped and is disposed on the respective fixed roof member so as to be able to align with the corresponding second track smoothly in a complete circle. More preferably, the openable roof further comprising second connecting means and a second driving means. Each of the second connecting means connects the second movable roof member to the first movable roof member and the fixed roof member. The second driving means drives the second movable roof means into motion. Each of the second connecting means is disposed adjacent to the corresponding second track of the first movable roof member, the coreesponding support track of the fixed roof member, and thhe corresponding first arc-shaped edge of the second movable roof member so as to allow the movement of the corresponding second movable roof member.

In another aspect of the present invention, the fixed roof means are disposed eccentric to each other. Walls of each fixed roof means intersects walls of the other.

BRIEF DESCRIPTION OF THE DRAWINGS

FIG. 1 is a side cross-sectional view of a conventional openable roof.

FIG. 9 is a simplified plan view of the openable roof in FIG. 8.

DETAILED DESCRIPTION OF THE PREFERRED EMBODIMENTS

With reference to the accompanying drawings, various preferred embodiments of the present invention will be described hereinafter.

FIRST EMBODIMENT

Figure 2:
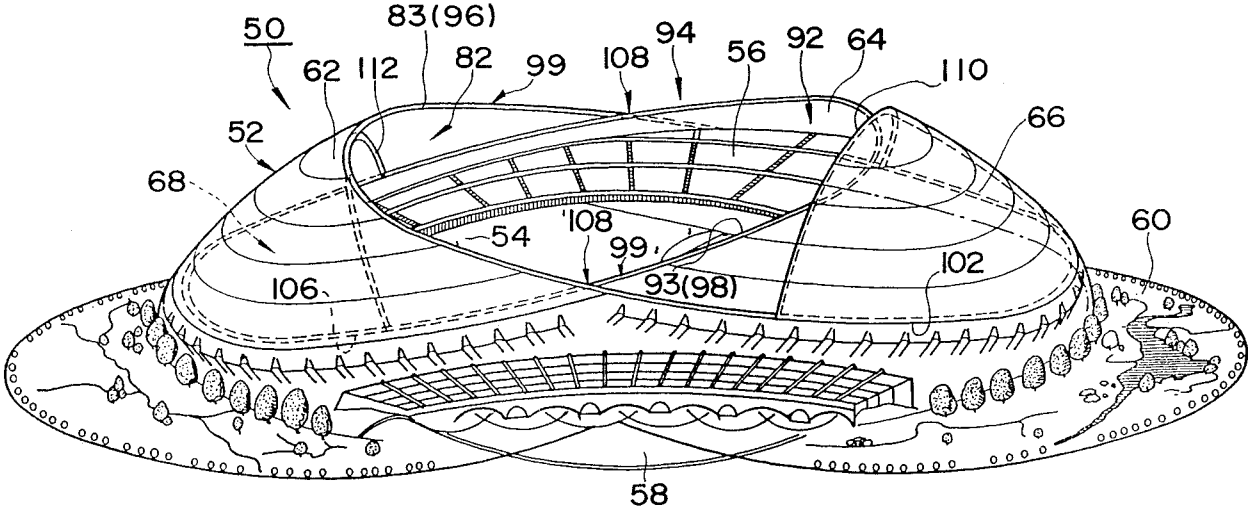
FIG. 2 is a perspective view of a stadium having an openable roof, according to a first embodiment of the present invention, when the roof is open.
Figure 3:
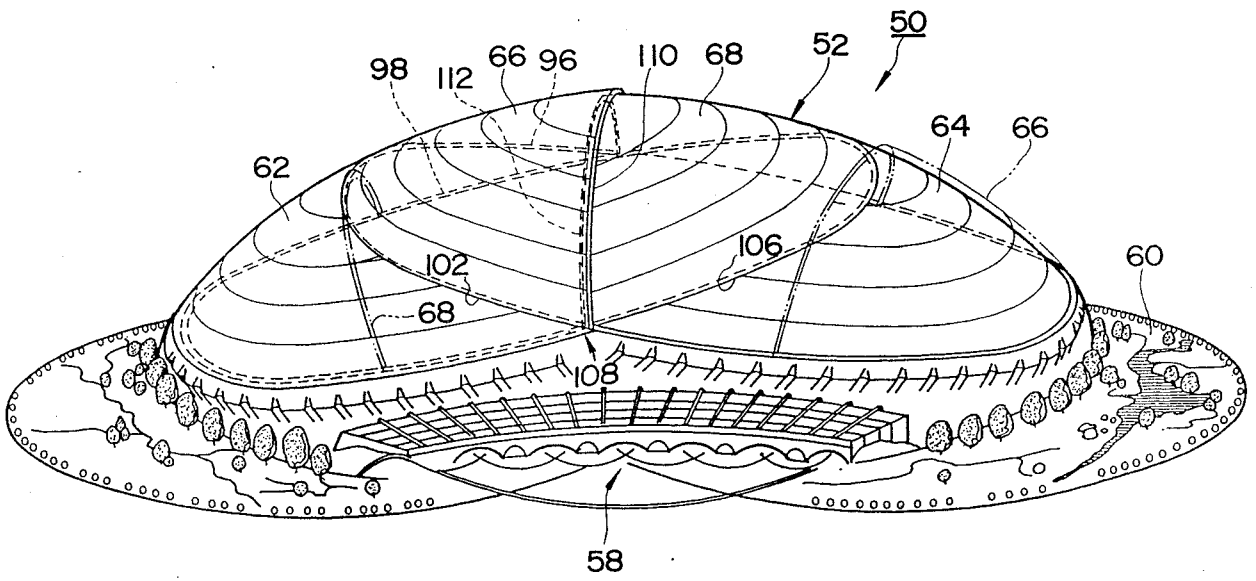
FIG. 3 is a perspective view of the stadium in FIG. 2 when the roof is closed off.

FIGS. 2 and 3 depict a stadium 50 comprising an openable roof 52 according to a first embodiment of the present invention. The stadium 50 comprises a generally circular playing field 54 for playing, for example, baseball, a generally circular audience gallery 56 disposed around the playing field 54, and a generally dome-shaped openable roof 52 having movable roof members 66 and 68, which when moved to the closed position will entirely cover the playing field 54 and the gallery 56. The stadium 50 has a plurality of entrance and exit portals 58. A park 60 surrounds the stadium.

The roof 52 comprises a pair of fixed roof members 62 and 64 fixedly constructed on level ground for constituting the lower portion of the roof 52, and a pair of movable roof members 66 and 68 which can be moved along tracks disposed on the fixed roof members 62 and 64 so as to form the upper part of the roof when roof is closed.

In general, as shown in FIG. 2, when the openable roof 52 is open, the roof 52 is of a shape such that the fixed roof members 62 and 64 (which are respectively portions of spheres with radii approximately equal to each other) overlap concentrically.

Figure 4:
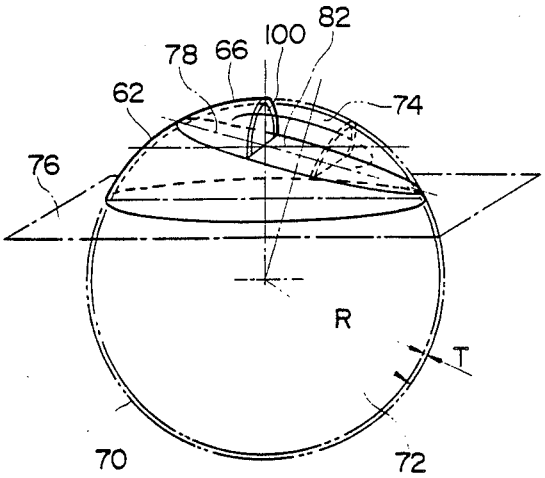
FIG. 4 is a simplified perspective view of the fixed roof member and the movable roof member in the openable roof in FIG. 2, showing a section of a spherical surface in which the roof members lie.
Figure 5:
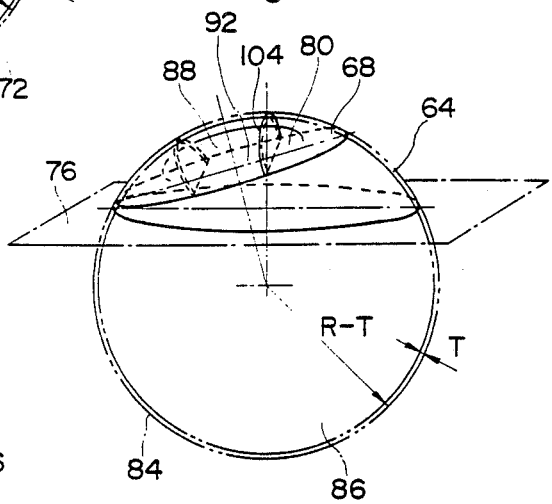
FIG. 5 is a simplified perspective view of the other fixed roof member and the other movable roof member in the openable roof in FIG. 2, showing a section of a spherical surface in which the roof members lie.
Figure 6:
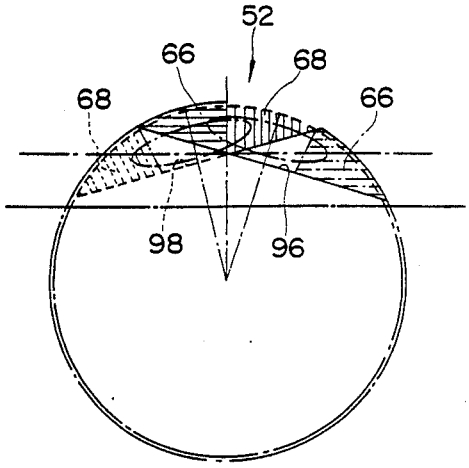
FIG. 6 is a simplified view showing the motion of the openable roof in FIG. 2, and showing the section of a spherical surface in which the roof members lie.

To more clearly illustrate, the shapes of the fixed roof members 62 and 64 are shown in FIGS. 4 and 5. As best shown in FIG. 4, the fixed roof member 62 is a portion of a sphere 70 of an outer radius R and thickness T, with two subsections 72 and 74 of the sphere removed. That is, subsection 72 is the larger section of the sphere 70 delimited by a plane 76 which passes through the sphere 70 above the center of the sphere. The plane 76 in FIG. 4 coincides with ground level in FIG. 2. The other subsection 74 of sphere 70 is delimited by a plane 78, which is not parallel to the plane 76, so as to produce an inclined opening 82 opening upwards and having a circular rim 83. The vertical axis of the circular opening 82 is inclined to the vertical axis of the section 72.

As best shown in FIG. 5, the other fixed roof member 64 is a portion of a sphere 84 of an outer radius (R−T) and thickness T with two subsections of the sphere removed. That is, subsection 86 is the larger section of the sphere 84 defined by plane 76 which intersects the sphere 84 above the center of the sphere 84. The other subsection 88 of sphere 84 is defined by plane 80, which is not parallel to the plane 76, and which produces an inclined opening 92 opening upwards and having a circular and planar rim 93. The vertical axis of the circular opening 92 is inclined to the vertical center axis of the sphere 84.

The openings 82 and 92 are equally inclined to each other so that the respective axes perpendicular to the openings 82 and 92 are inclined at the same angle to the ground. The heights of the tops of the openings 82 and 92 are generally the same.

Returning to FIG. 2, the fixed roof members 62 and 64 are overlapped concentrically. The fixed roof member 64 of the smaller radius (R−T) is substantially surrounded by, and fits within, the fixed roof member 62 of the greater radius (R).

The perpendicular axes of the opening 82 and 92 are inclined to each other in a vertical plane. Therefore, a complete opening 94 is formed above the playing field 54 when the openings 82 and 92 (of a generally oval shape when seen in top view, and of a V-shape when seen in front view) coincide.

The shape of each of the movable roof members 66 and 68 is a portion of a sphere, the outer surface of which forms a continuous smooth curved surface with the outer surface of each of the corresponding fixed roof members 62 and 64 when the roof is closed.

More specifically, as shown in FIG. 4, the movable roof member 66 is a portion of the subsection 74 with a further subsection, delimited by plane 100, removed. As similarly shown in FIG. 5, the moveable roof member 68, which is of generally the same shape as the moveable roof member 66, is a portion of the subsection 88 (with a further subsection, delimited by plane 104, removed).

The movable roof member 66 has first and second arc-shaped edges 102 and 110, and the movable roof member 68 has first and second arc-shaped edges 106 and 112. The first arc-shaped edge 102 opposes the rim 83 of the opening 82, and the first arc-shaped edge 106 opposes the rim 93 of the opening 92. The second arc-shaped edge 110 is inclined to the rim 83 of the opening 82, and the second arc-shaped edge 112 is inclined to the rim 93 of the opening 92.

The movable roof member 66 is connected via a connecting means 97 at the first arc-shaped edge 102 to the opening 82 of the fixed roof member 62. The movable roof member 68 is connected via a connecting means 99 at the first arc-shaped edge 106 to the opening 92 of the fixed roof member 64. Each of the connecting means 97 and 99, which allow movement of the moveable roof members 66 and 68, comprises a track formed on the fixed roof member and a wheel mechanism disposed on the moveable roof member.

The circular rail tracks 96 and 98 are disposed on the rims 83 and 93 of the openings 82 and 92, for circular movements of the moveable roof members 66 and 68.

The movable roof members 66 and 68 have the wheel mechanisms (not shown), respectively, at the first arc-shaped edges 102 and 110 thereof. Each of the wheel mechanisms of the movable roof members 66 and 68 can travel along the circular tracks 96 or 98 of the fixed roof member 62 or 64. The moveable roof members 66 and 68 have driving mechanisms (not shown) for driving the wheel mechanism. Consequently, each of the moveable roof members 66 and 68 always covers at least a portion of the corresponding opening 82 or 92 and is able to move along the corresponding track 96 or 98.

Other mechanisms, such as pneumatic levitation mechanisms or magnetic levitation mechanisms, can be utilized instead of the wheel mechanism, for smoother movement.

As shown in FIG. 3, when the movable roof member 66 is positioned at the uppermost position on the fixed roof member 62, the moveable roof member 66 extends past the central vertical plane which includes a pair of points 108 at which cross the rim 83 of the opening 82 and the rim 93 of the opening 92. Similarly, when the movable roof member 68 is positioned at the uppermost position on the fixed roof member 64, the moveable roof member 68 extends past the central vertical plane. Therefore, the moveable roof member 66 slightly overlaps the movable roof member 68 when both the movable roof members 66 and 68 are positioned at their highest positions and the second arc-shaped edges 110 and 112 of the moveable roof members 66 and 68 are parallel to each other.

With the configuration shown in FIG. 2, the movable roof members 66 and 68 are positioned at the lowermost positions. In the configuration, the complete opening 94, constituted by the openings 82 and 92, is opened so that the playing field 54 and the audience gallery 56 are exposed to the outer environment. Since the inner radius of the moveable roof member 66 is equal to (R−T), The movable roof member 66 overlaps the fixed roof member 64. Since the outer radius of the movable roof member 68 is equal to (R−T), the movable roof member 68 is hidden under the fixed roof member 62.

As shown in FIG. 3, in order to completely close the complete opening 94, the movable roof members 66 and 68 are positioned at their uppermost positions. The moveable roof member 66 is moved along the track 96 on the rim 83 of the opening 82, and the movable roof member 68 is moved along the track 98 on the rim 93 of the opening 92. Since each of the movable roof members 66 and 68 is a portion of a sphere, they cooperate to form generally a portion of a spherical surface when closing the complete opening 94.

When closed, the second arc-shaped edges 110 and 122 of the movable roof members 66 and 68 are overlapped one on the other so that the interior of the stadium 50 is protected from inclement weather. Then, the entire openable roof generally forms a portion of a spere so as to surround the playing field 54 and the audience gallery 56.

Since the tracks 96 and 98 are independent from each other and the movable roof members 66 and 68 have different radii, the roof members 66 and 68 can be moved independently.

Consequently, if the movable roof members 66 and 68 are moved synchronously in the same direction to open the roof, the overlapped second arc-shaped edges gradually move apart. For the audience in the stadium, the opening first appears as a narrow line, which broadens so that the area of visible sky gradually increases in a parallel rotating relation. p If the moveable roof members 66 and 68 are revolved in opposite directions, a generally wedge-shaped opening increasingly broadens to the full oval view for the stadium audience.

In the stadium 50 having the opening roof 52, and the roof 52 is opened so that sunlight, fresh air, a view of the sky, and a feeling of freedom may be enjoyed when the weather is fine. In addition, the roof 52 is closed so that the watching or the playing of a game is unaffected by inclement weather.

Since the entire openable roof 52 is a portion of a sphere, and since in particular the fixed roof members 62 and 64 supporting the movable roof members 66 and 68 are portions of a sphere, the openable roof 52 has sufficient strength at all positions of the movable roof members 62 and 64.

The movable roof members 66 and 68 can move smoothly along the circular tracks 96 and 98 because track is circular. In addition, since the movable roof members 66 and 68 can be moved independently, various opening and closing operations are achieved for the enjoyment of the audience.

Since the movable roof members 66 and 68 are overlapped to the fixed roof members 64 and 62, respectively, when the roof 52 is open, it is unnecessary to provide additional space for containing the movable roof members 66 and 68 as is the case in the prior-art roof.

The openable roof 52 is a dome structure, which was difficult to achieve by the prior art. In the stadium 50, there is no distinction between wall and roof. The movable roof members 62 and 64, which are parts of the roof 52, move past each other. Therefore, the roof 52 is of a modern shape from a design point of view.

Such a roof is preferable especially for a baseball or large general purpose stadium since the roof is of a dome shape with a high central ceiling.

Furthermore, while the roof has relatively simple components, the movements of the movable roof members 66 and 68 passing across the tracks 98 and 96 give an impression of complex movement. As a result, the audience can experience various unexpected visual impressions.

In the above explanation and in the drawings, the smaller fixed roof member 64 is surrounded by the larger fixed roof member 62. However, in order to reduce structural requirements, it is possible to omit construction of the lower portion of the smaller fixed roof member 64 hidden under the larger fixed roof member 62 and the portion of the track 98 on the rim 93.

SECOND EMBODIMENT

Figure 7:
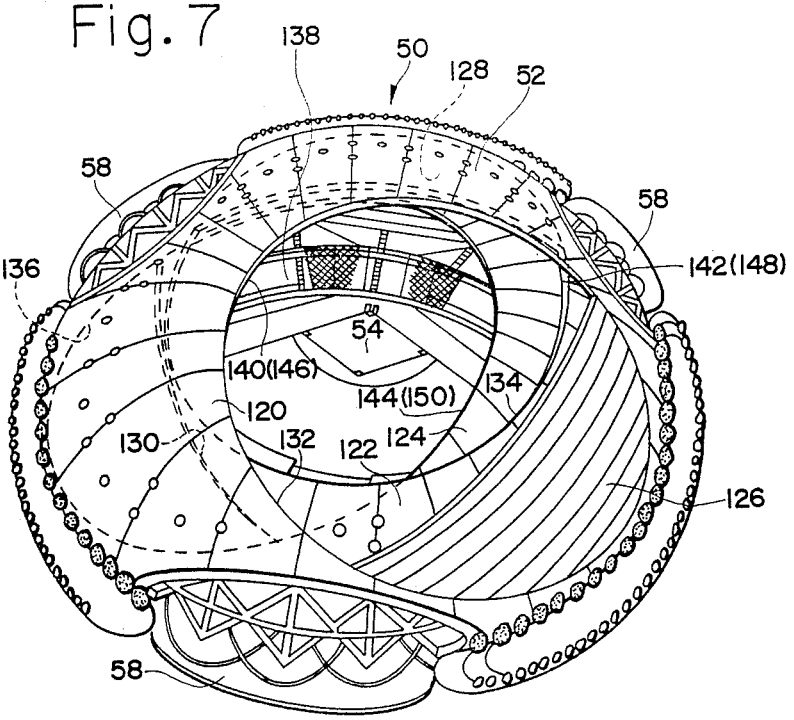
FIG. 7 is a perspective view of a stadium having an openable roof, according to a second embodiment of the present invention, when the roof is open.
Figure 8:
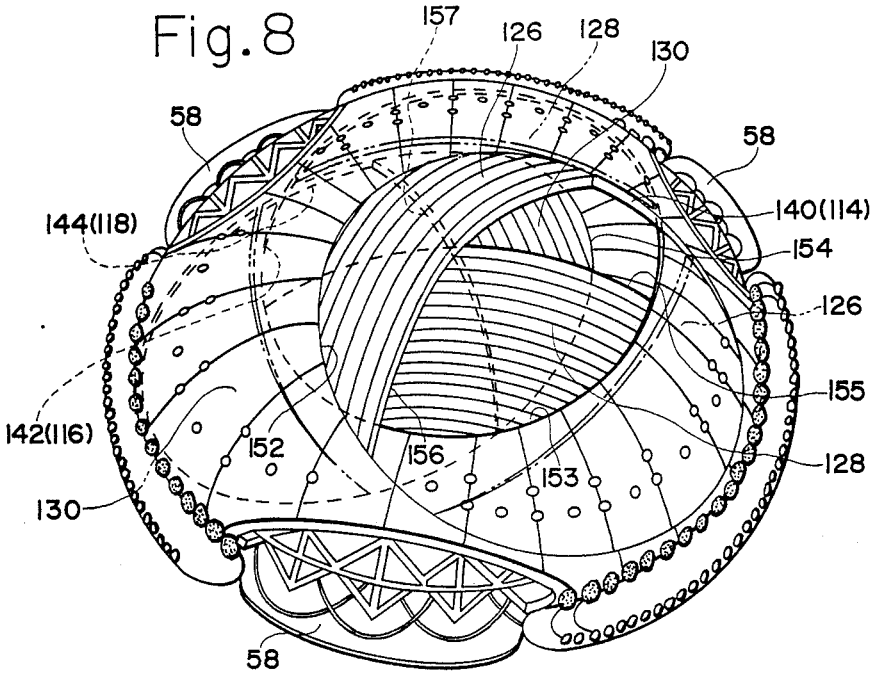
FIg. 8 is a perspective view of the stadium in FIG. 7 when the roof is closed.

FIGS. 7 and 8 depict a stadium 50 comprising an openable roof 52 according to a second embodiment.

In the first embodiment, the number of fixed roof members is two and the number of movable roof members is two. However, in the second embodiment, the number of the fixed roof members is three and the number of the movable roof members is three.

The openable roof 52 comprises three fixed roof members 120, 122, and 124 fixedly constructed on the ground, and three movable roof members 126, 128 and 130.

In general, in FIG. 7, when the openable roof 52 is open, the roof 52 is of such a shape that the fixed roof members 120, 122, and 124 (which are respectively portions of spheres of approximately equal radii) are concentrically nested.

More specifically, the shape of the fixed roof members 120, 122, and 124 is the same as the fixed roof member 62 in FIG. 4 according to the first embodiment. If the thickness of the fixed roof members 120, 122, and 124 equals T and the outer radius of the fixed roof member 120 equals R, the outer radius of the roof member 122 is (R−T). The radius of the roof member 124 is (R−2T). Consequently, the fixed roof members can be nested one in the other.

The fixed roof members 120, 122, and 124 are arranged in the manner shown in FIG. 9. Central axes of the openings 132, 134, and 136 are at 120° to one another as seen in FIG. 9 (top view) and are inclined radially outwards of the roof 52 at equal angles.

Consequently, there is provided a complete opening 138 of a generally triangular shape resulting from the coincidence of the openings 132, 134, and 136.

An entrance and exit portal 58 is built at the lowermost circumferential portion of the fixed roof members 120, 122, and 124, so that the portals are spaced at 120° one from the other. As best shown in FIGS. 7 and 8, each of the portals 58 is positioned so as to be opposite each of the lowermost portions of the openings 132, 134, and 136 in order not to interfere with the movement of the movable roof members 126, 128, and 130.

Each of the movable roof members 126, 128, and 130 is a portion of a sphere so that when the roof is closed their outer surfaces form a part of a sphere continuously and smoothly with the outer surfaces of the corresponding fixed roof members 120, 122, and 124. More specifically, the radius of each movable roof member 126, 128, and 130 is the same as that of the corresponding fixed roof member 120, 122, and 124.

Each of the movable roof members 126, 128, and 130 has respectively first and second arc-shaped edges 152 and 155, 153 and 156, and 154 and 157. The first arc-shaped edges 152, 153, and 154 are respectively opposed to the corresponding rims 146, 148 and 150 of the corresponding openings 132, 134, and 136. The second arc-shaped edges 155, 156, and 157 are respectively equally inclined to the corresponding rims 146, 148, and 150.

The first arc-shaped edge 152 of the movable roof member 126 is opposed to the opening 132 of the fixed roof member 120 via a connecting means 114. The first arc-shaped edge 153 of the movable roof member 128 is opposed to the opening 134 of the fixed roof member 122 via a connecting means 116. The first arc-shaped edge 154 of the movable roof member 130 is opposed to the opening 136 of the fixed roof member 124 via a connecting means 118. Each of the connecting means 114, 116, and 118 allows the movement of the movable roof members 126, 128, and 130, respectively, and comprises a track formed on the fixed roof member and a wheel mechanism disposed on the movable roof member.

The circular rail tracks 140, 142, and 144 provided at the rims 146, 148, and 150 of the openings 132, 134, and 136, respectively, for circular movements of the movable roof members 126, 128, and 130.

Each of the movable roof members 126, 128, and 130 has a wheel mechanism (not shown) at the first arc-shaped edge 152, 154, or 156 thereof, in a manner similar to the connecting mechanism of the first embodiment. Furthermore, each of the movable roof member comprises the driving mechanism (not shown) similarly to the first embodiment, for driving the wheel mechanism. Therefore, each movable roof member always covers a portion of the corresponding opening while it moves along the track around the center vertical axis.

As shown in FIG. 8, when each of the movable roof members 126, 128 and 130 is positioned at the respective corresponding uppermost position of the openings 132, 134, and 136, each of the second arc-shaped edges 155, 156, and 157 of the movable roof members 126, 128, and 130 protrude past the common vertical center axis of the fixed roof members 120, 122, and 124 towards the corresponding lowermost portion of the corresponding opening 132, 134, and 136. Therefore, at the common center vertical axis of the fixed roof members 120, 122, and 124, the second arc-shaped edge 155 of the movable roof member 126 is slightly overlapped on the second arc-shaped edge 156 of the movable roof member 128, which is slightly overlapped on the second arc-shaped edge 157 of the movable roof member 130, when the movable roof members 126, 128, and 130 are positioned at the highest position, respectively.

The openable roof 52 according to the above secod embodiment is driven in a manner similar to the first embodiment If the movable roof members 126, 128, and 130 are revolved in the same direction, the action thereof is similar to the action of the lens-shutter of a camera.

The openable roof 52 has the same advantages as described for the first embodiment. Furthemore, each of the movable roof member can be smaller and of reduced weight since the number of movable roof members is increased.

THIRD EMBODIMENT

Figure 10:
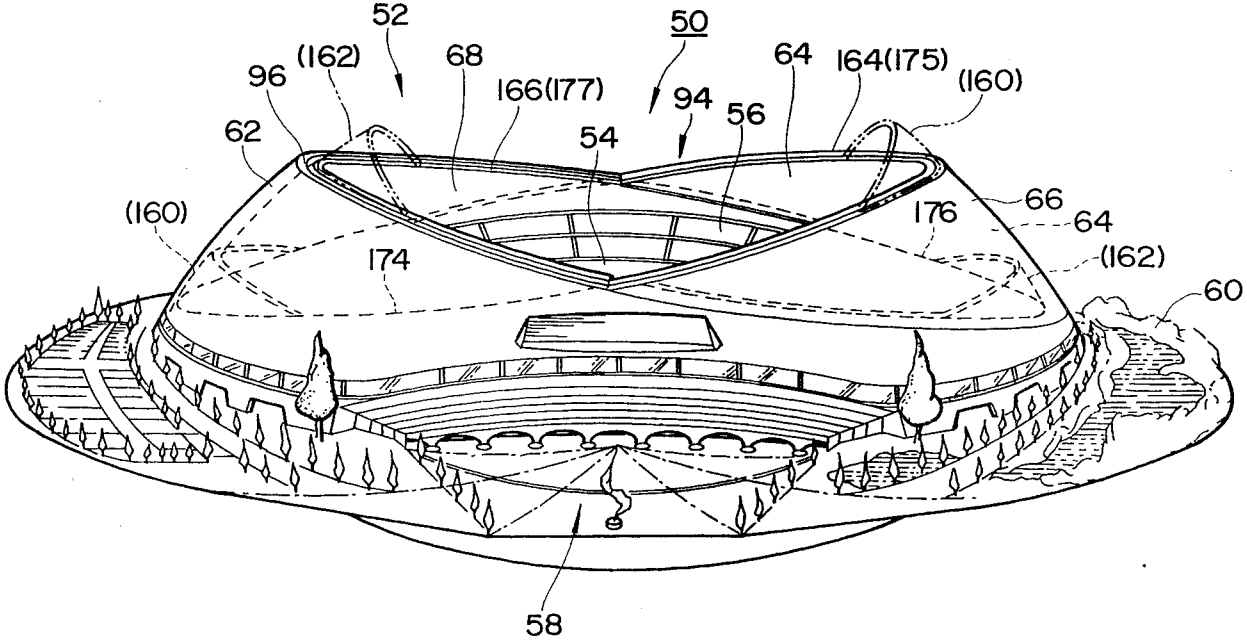
FIG. 10 is a perspective view of a stadium having an openable roof, according to a third embodiment of the present invention, when the roof is open.
Figure 11:
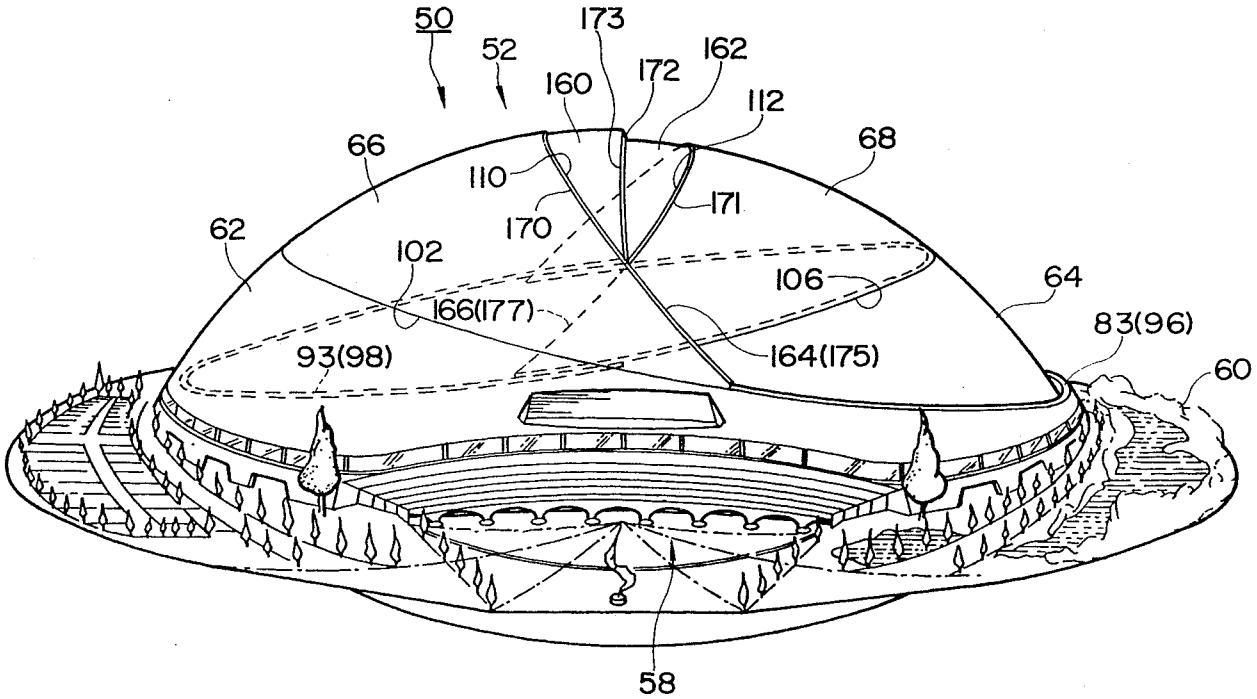
FIG. 11 is a perspective view of the stadium in FIG. 10 when the roof is closed.

FIGS. 10 and 11 depict a stadium 50 comprising an openable roof 52 according to a third embodiment.

The openable roof 52 comprises two fixed roof members 62 and 64, two first movable roof members 66 and 68, and two second movable roof members 160 and 162. The composition and configuration of the fixed roof members 62 and 64, and the relationship between the fixed roof members 62 and 64 and the first movable roof member 66 and 68 is similar to the first embodiment, so that description is here omitted. In addition, the tracks 96 and 98 will be referenced as the first tracks 96 and 98 hereinafter. The openable roof of the third embodiment comprises the connecting means 97 and 98 and the driving mechanism similar to the first embodiment, although they are not shown clearly. Therefore, the first movable roof members are driven into revolution around the corresponding openings.

Figure 12:
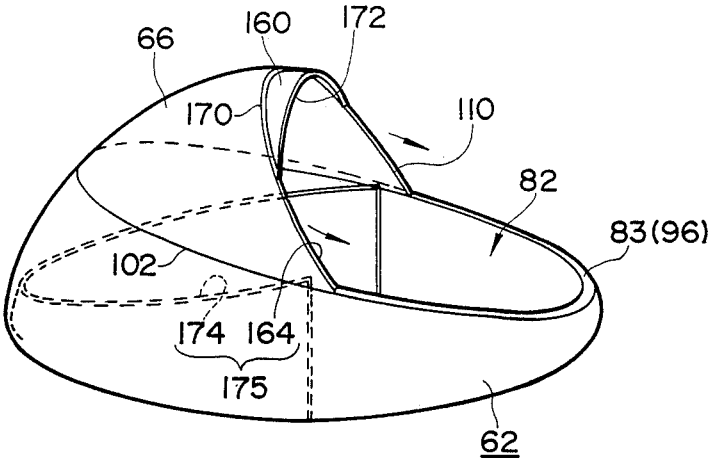
FIG. 12 is a simplified perspective view of a fixed roof member, a first movable roof member, and a second movable roof member, used in the openable roof in FIG. 10.
Figure 13:
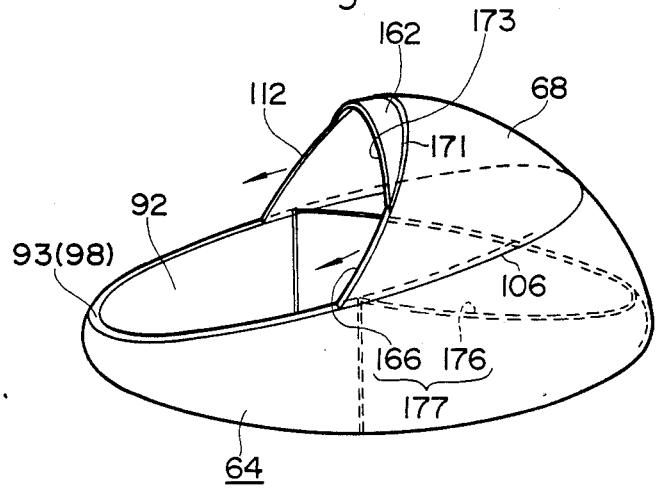
FIG. 13 is a simplified perspective view of the other fixed roof member, first movable roof member, and second movable roof member, used in the openable roof in FIG. 10.

FIG. 12 depicts a set comprised of the fixed roof member 62, the first movable roof member 66, and the second movable roof member 160. FIG. 13 depicts another set comprised of the fixed roof member 64, the first movable roof member 68, and the second movable roof member 162. In comparison with the first embodiment, the angle of inclination of the planes to the horizontal, on which the opening 82 and 92 of the fixed roof members 62 and 64 lie, is smaller; therefore the areas of openings 82 and 92 are greater.

As compared with the first embodiment, the angle of inclination of the second arc-shaped edges 110 and 112 to the tracks 96 and 98, respectively, is smaller, and the lengths of the first arc-shaped edges 102 and 106 are longer.

Figure 14:
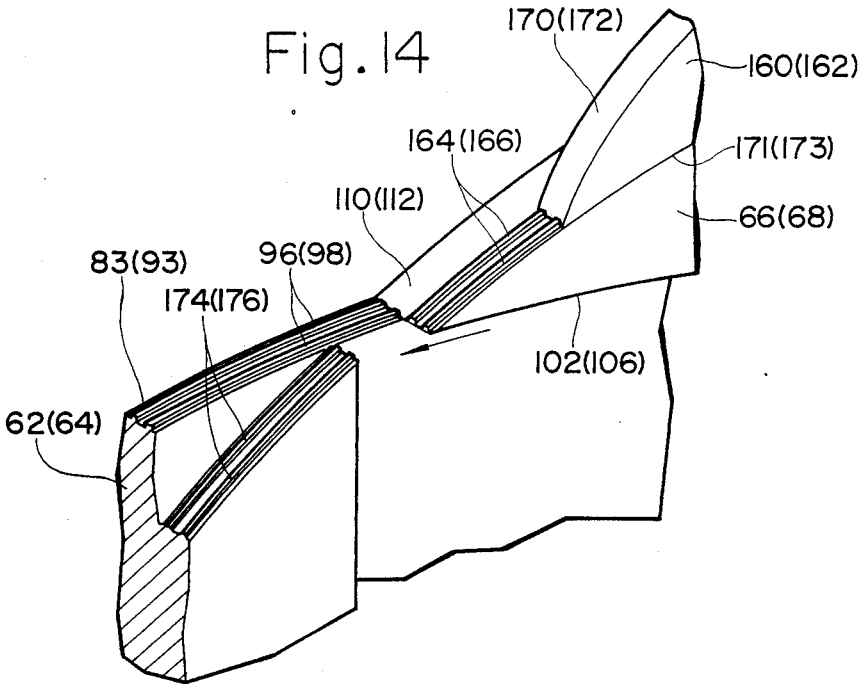
FIG. 14 is a perspective view showing the tracks in the openable roof in FIG. 10, on which the roof members move, when the second track and the support track do not meet.

As shown in FIG. 14, the outer surface of the first movable roof member 66 meets with the outer surface of the fixed roof member 62 and the outer surface of the first movable roof member 68 meets with the outer surface of the fixed roof member 64. However, the thickness of each of the first roof members 66 and 68 is nearly double that of each of the fixed roof members 62 and 64. The thickness T1 of the first movable roof members 66 or 68 is defined as follows:

$$T1 = T2 + T3 + \alpha$$

where T2 is the thickness of the fixed roof members 62 or 64, T3 is the thickness of the second movable roof members 160 or 162 (which will be explained later), and $\alpha$ is a positive constant.

Figure 15:
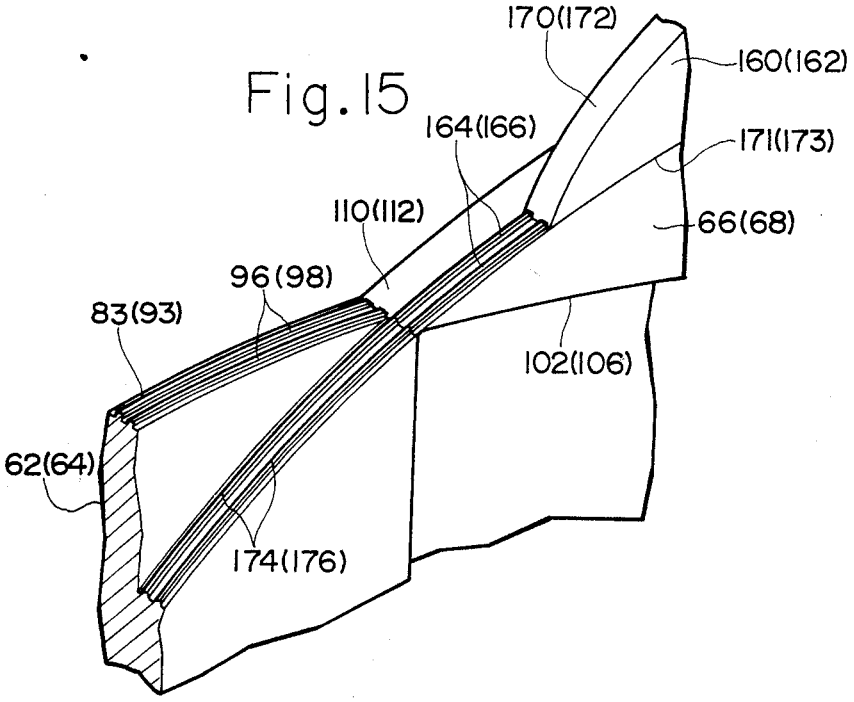
FIG. 15 is a perspective view showing tracks, in the openable roof in FIG. 10, on which the movable roof members travel when the second track and the support track are aligned.

The second movable roof members 160 and 162 are disposed on the second arc-shaped edges 110 and 112 respectively and move along the circular second arc-shaped edges 110 and 112. Each of the second movable roof members 160 and 162 is also a portion of a sphere. As shown in FIG. 11, the second movable roof members 160 and 162 have approximately the same radius as the roof members 62, 64, 66, and 68. However, as shown in FIG. 12 and 13, the outer radius of the second movable roof member 160 is less than the inner radius of the fixed roof member 62. The outer radius of the second movable roof member 162 is less than the inner radius of the fixed roof member 64. As shown in FIGS. 14 and 15, when the second movable roof member 160 is disposed on the first movable roof member 66, the inner surface of the second movable roof member 160 and the inner surface of the first movable roof member 66 form a portion of a sphere. Similarly, when the second movable roof member 162 is disposed on the first movable roof member 68, the inner surface of the second movable roof member 162 and the inner surface of the first movable roof member 68 form a portion of a sphere.

The second movable roof member 160 has first and second arc-shaped edges 170 and 172, and the second movable roof member 162 has first and second arc-shaped edges 171 and 173. The first arc-shaped edges 170 and 171 are respectively opposed to the second arc-shaped edges 110 and 112 of the first movable roof members 66 and 68. The second arc-shaped edges 172 and 173 are respeactively inclined to the second arc-shaped edges 110 and 112 of the first movable roof members 66 and 68.

The first arc-shaped edge 170 of the second movable roof member 160 is opposed to the second arc-shaped edge 110 of the first movable roof member 66 via a connecting means 175. If necessary, the second movable roof member 160 at the first arc-shaped edge 170 can be oppposed to a support track of the fixed roof member 62 movably inside of the fixed roof member 62 via a connecting means 175. The first arc-shaped edge 171 of the second movable roof member 162 is opposed to the second arc-shaped edge 112 of the firsst movable roof member 68 via a connecting means 177. If necessary, the second movable roof member 162 at the first arc-shaped edge 171 can be opposed to a support track of the fixed roof member 64 movably inside of the fixed roof member 64 via a connecting means 177.

Each of the connecting means 175 and 177 which allows movement of the second movable roof members 160 and 162 comprises a second track formed on the first movable roof member, a support track formed within the fixed roof member, and a wheel mechanism (not shown) disposed on the second movable roof member.

As shown in FIG. 14, the first movable roof members 66 and 68 respectively include second tracks 164 and 166 formed along the second arc-shaped edges 110 and 112. The second tracks 164 and 166 are similar to the first tracks 96 and 98. The second tracks 164 and 166 are disposed radially inward of the second arc-shaped edges 110 and 112 so at to spaced apart from the first tracks 94 and 98 in parallel relation. At the ends of the second arc-shaped edges 110 and 112, the second tracks 164 and 166 are formed so as to connect with the support tracks 174 and 176, which will be described later.

Each of the second movable roof members comprises a second driving mechanism (not shown) for driving the corresponding wheel mechanism. Thus, the second movable roof members are driven into motion.

Figure 16:
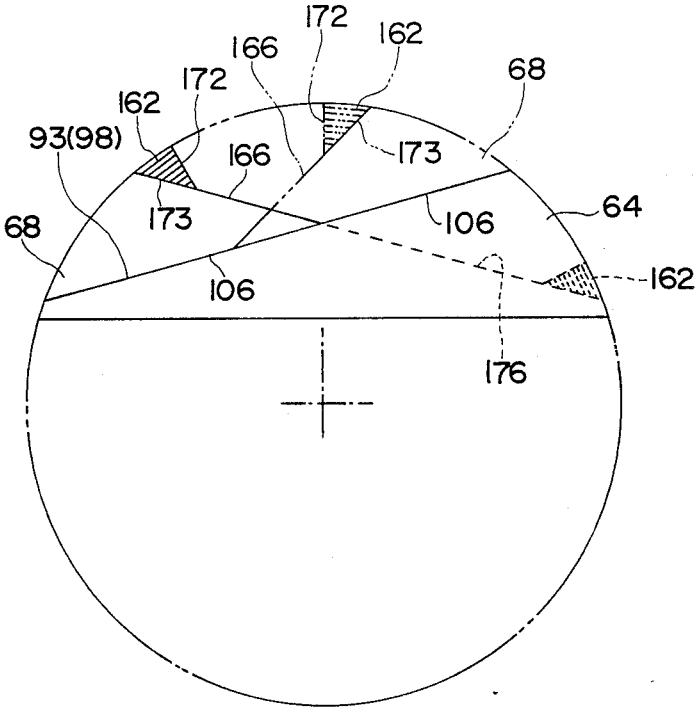
FIG. 16 is a simplified side view of a fixed roof member, and first and second movable roof members used in the openable roof in FIG. 10, showing a section of a spherical surface in which the roof members lie.

FIGS. 11 and 16 illustrate that the second movable roof members 160 and 162 are disposed on the tracks 164 and 166, respectively. When the first movable member 66 is positioned at the uppermost position on the fixed roof member 62 and the second movable member 160 is positioned at the uppermost position on the first movable member 66, the second movable roof member 160 extends past the vertical center plane of the roof 52 in such a manner that the second arc-shaped edge 172 is parallel to the vertical center plane.

When the first movable member 68 is positioned at the uppermost positions on the fixed roof member 64 and the second movable member 162 is positioned at the uppermost position on the first movable member 68, the second movable roof member 162 extends past the vertical center plane in such a manner that the second arc-shaped edge 173 is parallel to the vertical center plane. Therefore, the second arc-shaped edge 170 of the second movable member 160 slightly overlaps the second arc-shaped edge 172 of the second movable member 162 in order to protect the interior of the stadium 50 from the elements.

As best shown in FIGS. 12 and 13, the fixed roof members 62 and 64 further have the support tracks 174 and 176, respectively, in order that the second movable roof members 160 and 162 may travel along the support tracks 174 and 176 hidden in the fixed roof members 62 nd 64. When the first movable roof member 66 is positioned at the lowermost position on the first track 92, the end of the support track 174 is aligned with the end of the second track 164 as shown in detail in FIG. 15. Consequently the second track 164 and the support track 174 form a complete circular track on which the second movable roof member 160 moves.

Similarly, when the first movable roof member 68 is positioned at the lowermost position on the first track 98, the end of the support track 176 is aligned with the end of the second track 166. Consequently the second track 166 and the support track 176 form a complete circle on which the second movable roof member 162 moves.

Becacue of the existence of the support track 174, the outer radius of the fixed roof member 64 which is disposed in the fixed roof member 62, is slightly less than the difference between the inner radius of the fixed roof member 62 and the thickness of the support track 174. Consequently, the concentricity of the fixed roof members 62 and 64 can be achieved.

The dome-shaped openable roof 52, when closed to surround the interior, the playing field 54, and the audience gallery 56, is illustrated in FIG. 11.

In order to close the openable roof 52, first the second openable roof members 160 and 162 are positioned at the uppermost positions, i.e., the middle positions of the second tracks 164 and 166. The first movable roof members 66 and 68 (with the second movable roof members 160 and 162 stationary) are next positioned at the uppermost positions of the first tracks 96 and 98.

Since the first arc-shaped edges 102 and 106 of the first movable roof members 66 and 68 are of a length greater than half that of the first tracks 96 and 98, the ends of the first movable roof members 66 and 68 overlap. Furthermore, the second arc-shaped edges 170 and 172 overlap so that the complete opening 94 is closed by the first and second movable roof members 66, 68, 160, and 162.

Actually, since the fixed roof members 62 and 64 are spaced apart as mentioned above, the second arc-shaped edges 170 and 172 are also spaced apart. Therefore, there is provided a packing member (not shown), e.g., a curtain-like packing member at the outer second arc-shaped edge 170 which extends toward the inner second arc-shaped edge 170 for occupying the space remaining when the second arc-shaped edges 170 and 172 overlap. Alternatively, the thickness or the curvature of one of the second movable roof members 160 and 162 can be altered near the second arc-shaped edges 170 and 172 in order to close the space.

In order to open the openable roof 52, the first movable roof members 66 and 68 (with the second movable roof members 160 and 162 stationary) are first positioned at the lowermost positions, i.e., the middle positions of the first tracks 96 and 98. Since the fixed roof members 62 and 64 are respectively portions of spheres which are of different radii, the first movable roof member 66 overlaps the fixed roof member 64 and the first movable roof member 68 passes under the fixed roof member 62.

Accordingly, the complete opening 94 is nearly fully open. Next, the second openable roof members 160 and 162 are respectively moved along the second tracks 164 and 166 and transferred to the support tracks 174 and 176 (see FIG. 15). Then, the second openable roof members 160 and 162 are respectively moved along the support tracks so as to be positioned at the lowermost positions, i.e., the middle positions of the support tracks 174 and 176 (see FIG. 16). As shown in FIG. 10, when the second openable roof members 160 and 162 are positioned at the lowermost positions, the second openable roof members 160 and 162 are hidden under the walls of the fixed roof members 62 and 64, respectively. Since the fixed roof member 64 is positioned radially inward of the support track 176, the second roof members 160 and 162 can be moved independently.

Consequently, the complete opening 94 can be fully opened so that the playing field 54 and the audience gallery 56 are exposed to the outer environment.

The openable roof 52 is closed by reversing the steps of the opening procedure above. That is, first, the second openable roof members 160 and 162 are respectively moved along the support tracks 174 and 176, and are transferred on the second tracks 164 and 166. Next, the second openable roof members 160 and 162 are respectively moved along the second tracks to be positioned at the uppermost positions of the second tracks 164 and 166. Then, the first openable roof members 66 and 68 (with the second movable roof members 160 and 162 stationary) are revolved around the first tracks 96 and 98 to be positioned at the uppermost positions of the first tracks 96 and 98.

In the third embodiment, the following advantages can be achieved as well as advantages similar to those in the first embodiment.

Since the second movable roof members move on the first movable members or the fixed roof members, the complete opening 94 has a larger area than if there were fewer movable roof members.

The second movable roof members, which are positioned on the first movable roof members when the roof is closed, are moved to be stored under the fixed roof members 62 and 64 through the other tracks (support tracks). Therefore, the audience in the stadium 50 experiences an unexpected visual amusement, e.g., functional and dynamic beauty when the roof is opened and closed.

Figure 17:
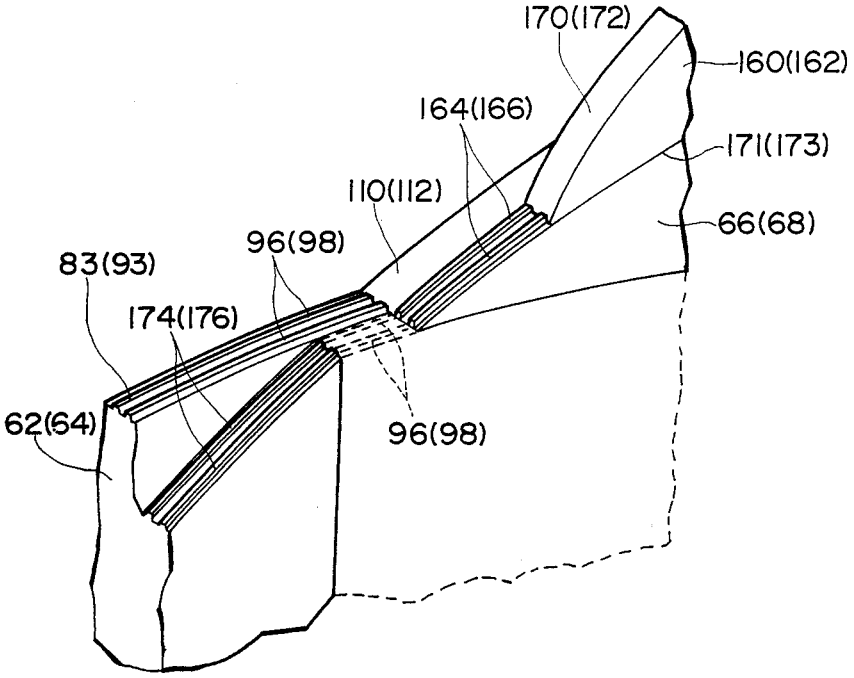
FIG. 17 is a perspective view showing a modification of tracks on which the roof members travel in the openable roof in FIG. 1.

In the third embodiment, as shown in FIG. 17, the fixed roof member 62 excluding the section over the support track 174 can have a thickness equal to the sum of the thicknesses of the first track 96 and the support track 174 in order to receive the weigh of the movable roof members 66 and 160. The fixed roof member 64 excluding the section over the support track 176 can have a thickness equal to the sum of the thicknesses of the first track 98 and the support track 176 in order to receive the weigh of the movable roof members 68 and 162. Accordingly, the rigidity of the roof is improved. In this case, the thickness of the fixed roof members 64 and 66 is the same as the thickness of the first movable roof members 66 and 68. Therefore, it is preferable to increase the number of rails used in the first tracks 96 and 98.

In the third embodiment, since the outer radii of the first movable roof members 66 and 68 differ from those of the second movable roof members 160 and 162, there are gaps between the outer surfaces of the first movable roof members 66 and 68 and the second movable roof members 160 and 162. Therefore, it is preferable that ridges (not shown) protrude laterally from the second arc-shaped edges 110 and 112, the ridges have a thickness gradually decreasing from the second arc-shaped edges 110 and 112 to the distal ends thereof in order that these gaps are generally reduced in size so as to be unobtrusive.

FOURTH EMBODIMENT

Figure 18:
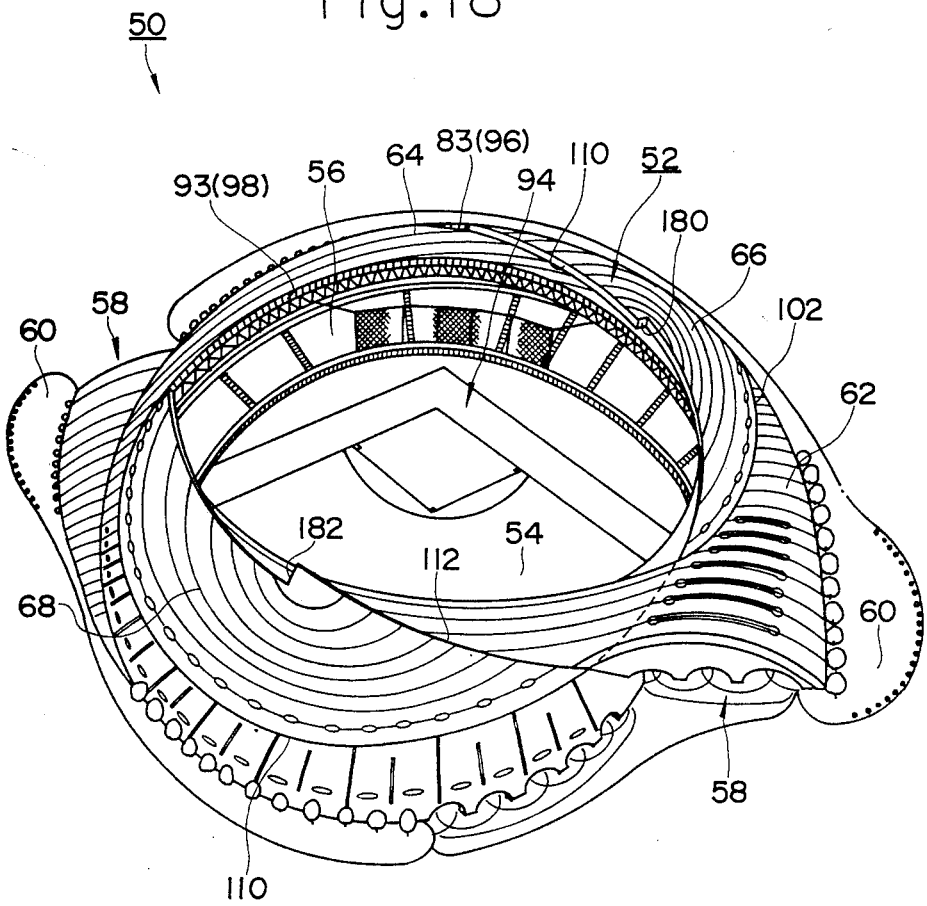
FIG. 18 is a perspective view of a stadium having an openable roof, according to a fourth embodiment of the present invention, when the roof is open.
Figure 19:
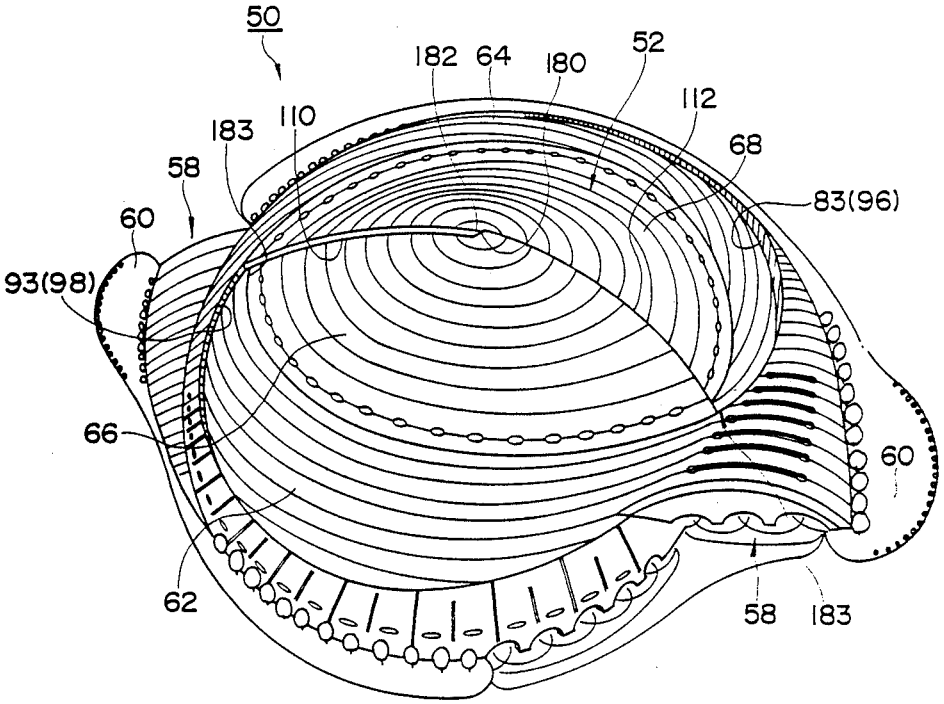
FIG. 19 is a perspective view of the stadium in FIG. 18 when the roof is closed.
Figure 20:
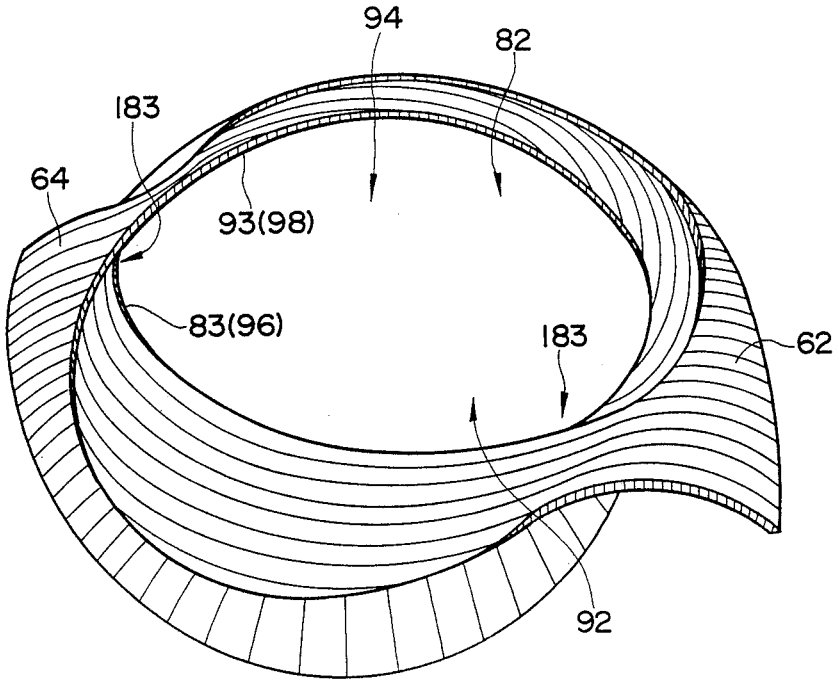
FIG. 20 is a perspective view of the fixed roof members used in the openable roof in FIG. 18.
Figure 21:
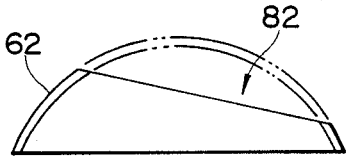
FIG. 21 is a simplified side view of one of the fixed roof members in FIG. 18.
Figure 23:
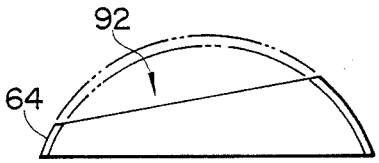
FIG. 23 is a simplified side view of the other fixed roof member in FIG. 18.
Figure 22:
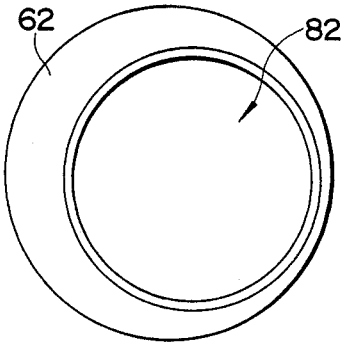
FIG. 22 is a simplified plan view of the fixed roof member in FIG. 21.
Figure 24:
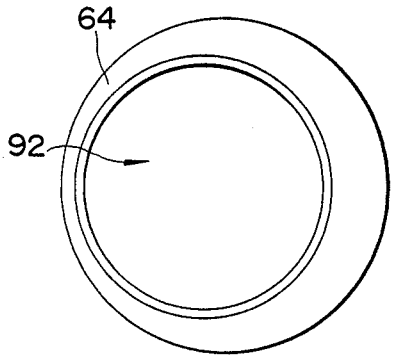
FIG. 24 is a simplified plan view of the fixed roof member in FIG. 23.

FIGS. 18 and 19 depict a stadium 50 comprising an openable roof 52 according to a fourth embodiment.

In the explanation of the fourth embodiment, components which are similar to the components of the first embodiment are similarly numbered and the description of the components is therefore omitted. The openable roof comprises the connecting means and the driving mechanisms similarly to the first embodiment, although they are not clearly shown.

As shown in FIGS. 21 through 24, the shapes of the fixed roof members 66 and 68 are similar to those in the first embodiment. However, the arrangements of the fixed roof members 66 and 68 are different. In addition, the inner and outer radii of the fixed roof member 66 are the same as those of the fixed roof member 68.

Figure 25:
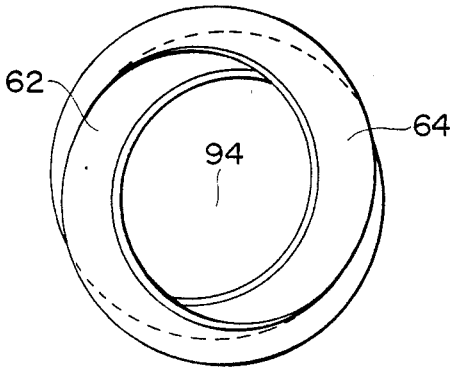
FIG. 25 is a simplified plan view of the fixed roof members in FIG. 20.

As shown in FIG. 25, the fixed roof members 62 and 64 are not arranged concentrically. The wall of the fixed roof member 66 intersects a portion of the wall of the other fixed roof member 68, and the wall of the fixed roof member 68 intersects a portion of the wall of the fixed roof member 66. Consequently, the complete opening 94 results from the coincidence of the openings 82 and 92.

The tracks 96 and 98 are provided to the rims 83 and 93 respectively with the exception of the portions where the fixed roof members intersect.

The movable roof members 66 and 68, which slide along the tracks 96 and 98, respectively, are generally the same shape as in the first embodiment. However, each of the second arc-shaped edges 110 and 112 has an L-shaped slit at the lengthwise center portion thereof. As illustrated in FIG. 19, the second arc-shaped edges 110 and 112, including the slits 180, are axially symmetric to each other so that the second arc-shaped edges 110 and 112 are engaged in order to close off the complete opening 94 when the roof 52 is closed.

Figure 26:
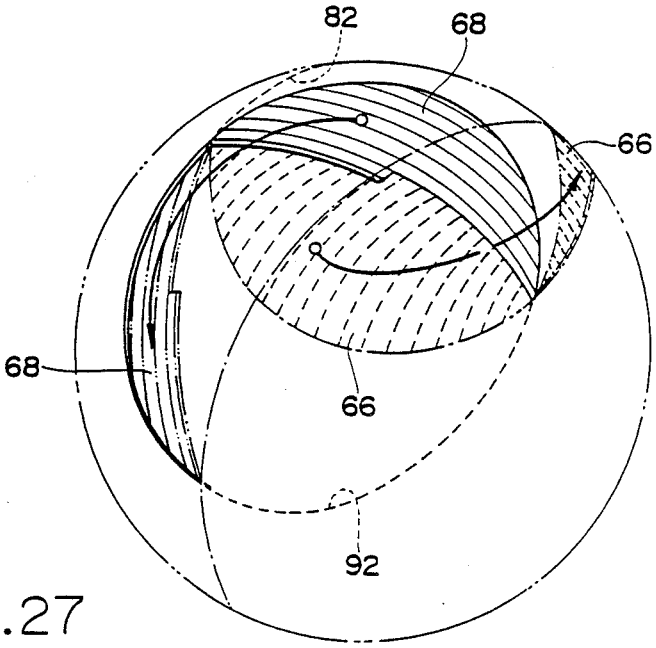
FIG. 26 is an explanatory view showing the direction of movement of both the movable roof members 66 and 68 in FIG. 18.

As shown in FIGS. 18, 19, and 26, in order to close the openable roof 52, the movable roof members 66 and 68 clockwise move along the tracks 96 and 98 as viewed from above. In order to open the roof 52, the movable roof members 66 and 68 are moved in the counterclockwise direction as viewed from above.

Since each of the tracks 96 and 98 is not an endless track but has ends, it is possible to dispose positioning mechanisms at the ends in order to engage the movable roof members 66 and 68.

As best shown in FIG. 19, there are differences in height between the movable roof members 66 and 68 equal to the thickness of the movable roof members 66 and 68 at two points 183 where the tracks 96 and 98 cross. Accordingly, the second arc-shaped edges 110 and 112 do not meet at the lateral ends thereof when the roof 52 is closed. In other words, there are gaps equal to the movable roof members 66 and 68 between the outer peripheral surfaces of the movable roof members 66 and 68 at the lateral ends. Therefore, it is preferable to form ridges protruding from the second arc-shaped edges 102 and 104 which overlap in order to protect the interior of the stadium 50 from inclement weather.

If a fixing mechanism is provided which can fix the movable roof members 66 and 68 in place when the roof 52 is closed, the roof will have improved rigidity and strength.

The openable roof 52 of the fourth embodiment has the same advantages as described in the first embodiment. Furthermore, both of the movable roof members can be manufactured of the same size and shape, so that the roof can be constructed at a lower cost.

Figure 27:
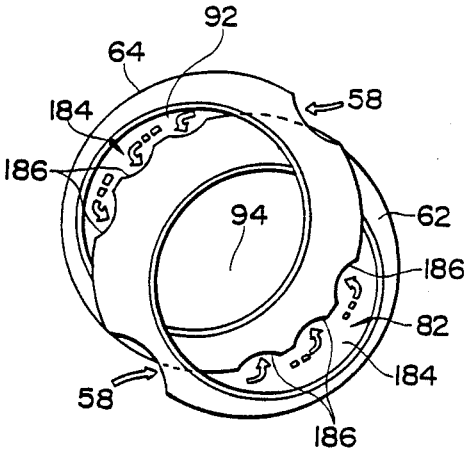
FIG. 27 is a simplified plan view of a modification of the arrangement of the fixed roof members, according to the fourth embodiment.
Figure 28:
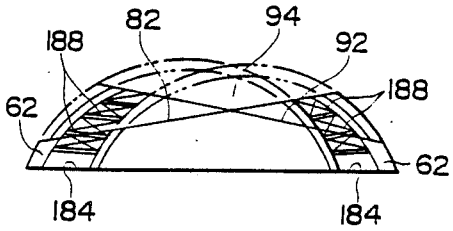
FIG. 28. is a simplified side view of the modification in FIG. 27.

The fixed roof members 62 and 64 are disposed slightly eccentric in FIGS. 18, 19, 20, and 25. A modification of the roof 52, in which the fixed roof members 62 and 64 are disposed extremely eccentrically, is shown in FIGS. 27 and 28. In the modification, there are provided two spaces 184 between the fixed roof members 62 and 64 or the outer wall and the inner wall.

The spaces 184 can be utilized as corridors of the stadium. The audience passes from a pair of entrance and exit portals 58 to a plurality of interior portals 186 through the corridors 184 for entrance into the gallery 56 of the stadium 50. Over the corridors 184, simple fixed roofs (not shown) bridge the fixed roof members 62 and 64, each of the simple fixed roofs having a profile which generally meets with the outer surfaces of the fixed roof members 62 and 64.

As best shown in FIG. 28, the fixed roof members 62 and 64 are bridged by girders 188 in order to give rigidity and strength.

FIFTH EMBODIMENT

Figure 29:
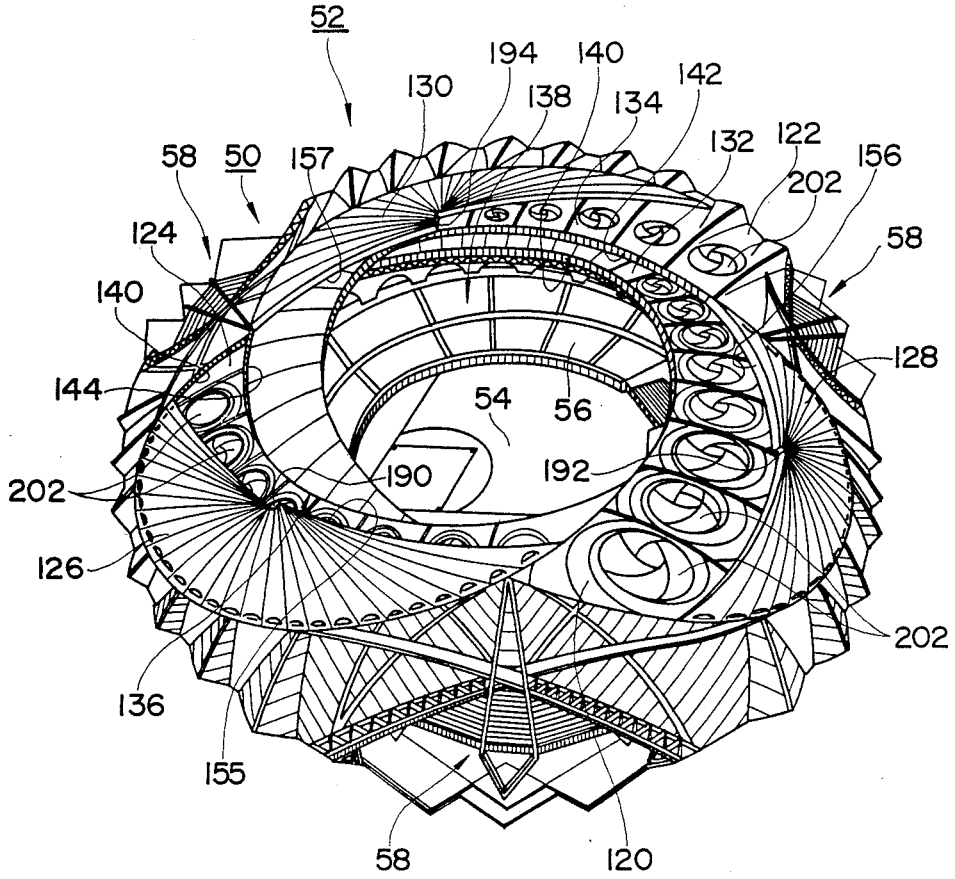
FIG. 29 is a perspective view of a stadium having an openable roof, according to a fifth embodiment of the present invention, when the roof is open.
Figure 30:
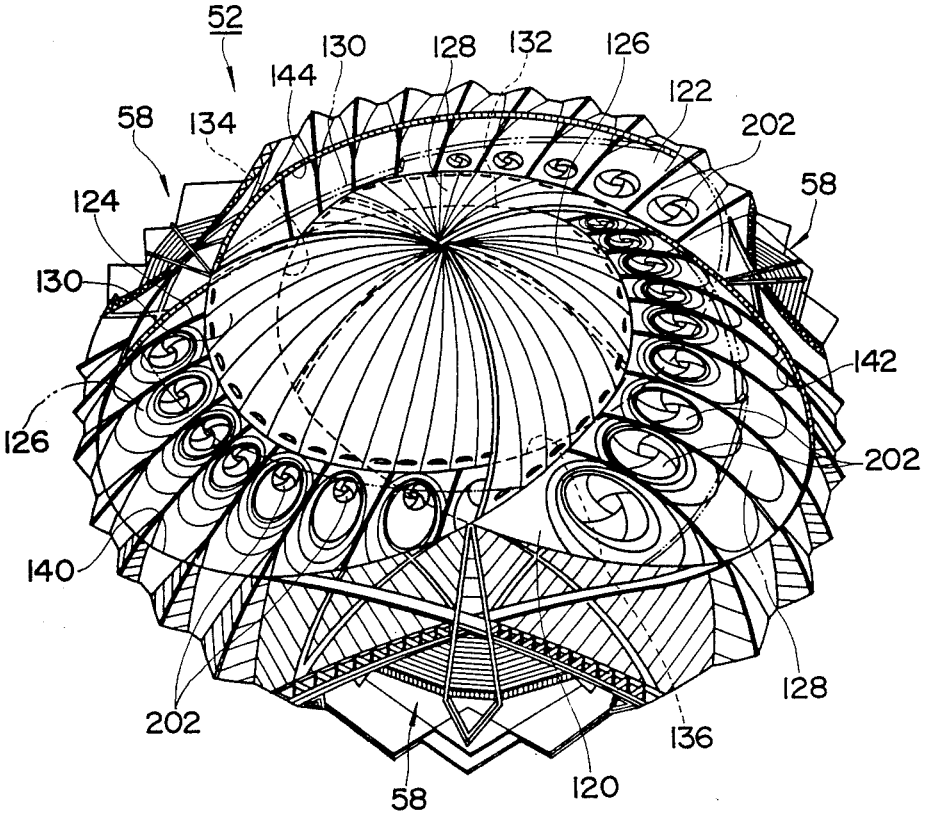
FIG. 30 is a perspective view of the stadium in FIG. 29 when the roof is closed.

FIGS. 29 and 30 depict a stadium 50 comprising a movable roof 52 according to a fifth embodiment.

In the explanation of the fifth embodiment, components which are similar to the components of the second embodiment are similarly numbered and the description of the components is therefore omitted. The openable roof comprises the connecting means and the driving mechanisms similarly to the second embodiment, although they are not clearly shown.

As shown in FIG. 29, the openable roof 52 comprises three fixed roof members 120, 122, and 124 which are disposed slightly eccentrically to one another at a prescribed value so that there is provided the complete opening 138 as a result of the coincidence of the openings 132, 134, and 136. The fixed roof members 120, 122, and 124 are located in an angularly spaced relation at 120°.

The movable roof members 126, 128, and 130 are rotatably mounted on the fixed roof members 120, 122, and 124, respectively. When the roof 52 is opened, the movable roof member 126 overlaps the fixed roof member 124, the movable roof member 128 overlaps the fixed roof member 120, and the movable roof member 130 overlaps the fixed roof member 122.

The second arc-shaped edges 152, 154, and 156 respectively have slits 190, 192, and 194, one of which can engage the other two at the same time. In other words, they engage one another when the roof is closed as shown in FIG. 30.

In FIGS. 29 and 30, reference numeral 202 indicates a plurality of skylights for the audience gallery 56 and corridors which are formed similarly to the modifications of the fourth embodiment.

Figure 31:
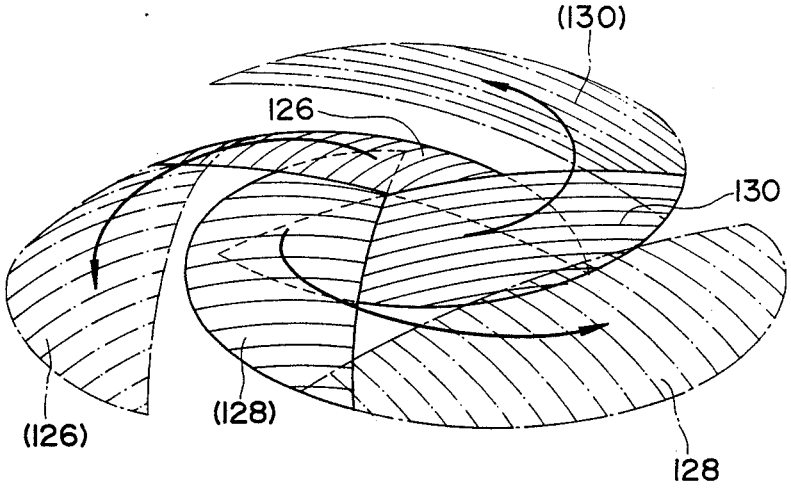
FIG. 31 is a simplified diagram showing the direction of the movement of the movable roof members shown in FIG. 29.

In order to close the roof, the movable roof members 126, 128, and 130 are moved counterclockwise as viewed from the top, as shown in FIGS. 29 and 31, along the tracks 140, 142, and 144, respectively, from the lowermost positions of the tracks 140, 142, and 144. The movable roof members 126, 128, and 130 move at a synchronized speed of rotation so as to be maintained in axially symmetric relation.

When the movable roof members 126, 128, and 130 overlap and the slits 190, 192, and 194 engage one another as shown in FIG. 30, the roof 52 is closed like a pin-wheel and the movements of the movable roof members 126, 128, and 130 are stopped.

The openable roof 52 is closed by reversing the steps of the opening procedure above. The movable roof members 126, 128, and 130 are moved counterclockwise when viewed from the top, That is, the movable roof members move like a camera shutter.

The openable roof 52 has the advantage similar to those described for the fourth embodiment. Furthermore, each of the movable roof members can be compact and light in weight since number of the movable roof members is increased. As a result, the tracks and the attachment of the track can be simplified.

What is claimed is:

1. An openable roof comprising:

a plurality of sets comprised of a fixed roof means and movable roof means;

said fixed roof means being fixedly constructed at prescribed locations, each of the fixed roof means having an opening substantially opening upwards, and a generally circular track around the opening; at least one part of each of the fixed roof means substantially intersecting a wall fo the other fixed roof means in such a manner that the openings partially coincide so as to form a complete opening;

said movable roof means being movably disposed on the fixed roof means, each of the movable roof means being disposed radially inside the circular tracks formed on the corresponding fixed roof means, each of the movable roof means having a first arc-shaped edge disposed on the corresponding circular first track, the curvature of the first arc-shaped edge corresponding to the curvature of the circular first track of the fixed roof means so that each of the movable roof means is able to revolve around an axis of the first track of the corresponding fixed roof means so as to participate to open and close the complete opening.

2. An openable roof as recited in claim 1, in which each fixed roof means comprises a section of a sphere, with a subsection removed, so as to produce said opening of a generally circular shape with a generally planar rim, on which is disposed said first track.

3. An openable roof as recited in claim 2, in which each of the movable roof means is generally a portion of said subsection of said sphere.

4. An openable roof as recited in claim 3, in which the circular openings are inclined to a horizontal plane in such a manner that at least the lowermost portions of the openings coincide when the roof is open.

5. An openable roof as recited in claim 4, in which the sets comprised of fixed roof means and movable roof means are generally sections of spheres, the spheres having slightly different radii and being disposed concentrically.

6. An openable roof as recited in claim 5, in which each of the movable roof means comprises a first movable roof member and a second movable roof member, the first and second movable roof members of the same movable roof means being subsections of the same sphere, each of the movable roof members having first and second arc-shaped edges, each of the first movable roof members being disposed at the first arc-shaped edge thereof movably on the first track of the corresponding fixed roof member, each of the first movable roof members having a second arc-shaped track adjacent to and along the second arc-shaped edge thereof, each of the second movable roof members being disposed at the first arc-shaped edge thereof movably on the second track of the corresponding first movable roof member.

7. An openable roof as recited in claim 6, the openable roof further comprisinbg a plurality of support tracks on which moves the second movable roof member transferred from the corresponding second track, each of the support tracks being arc shaped and being disposed on the respective fixed roof member so as to be able to align with the corresponding second track smoothly in a complete circle.

8. An openable roof as recited in claim 3, in which each of the movable roof means comprises a first movable roof member and a second movable roof member, the first and second movable roof members of the same movable roof means being subsections of the same sphere, each of the movable roof members having first and second arc-shaped edges, each of the first movable roof members being disposed at the first arc-shaped edge thereof movably on the first track of the corresponding fixed roof member, each of the first movable roof members having a second arc-shaped track adjacent to the second arc-shaped edge thereof, each of the second movable roof members being disposed at the first arc-shaped edge thereof movably on the second track of the corresponding first movable roof member.

9. An openable roof as recited in claim 8, the openable roof further comprises a plurality of support tracks on which moves the second movable roof member transferred from the corresponding second track, each of the support tracks being of an arc shape and being disposed on the respective fixed roof member so as to be able to connect with the corresponding second track smoothly in a complete circle.

10. An openable roof as recited in claim 3, in which the fixed roof means are disposed eccentric to each other, wall of each fixed roof means intersecting wall of the other.

11. An openable roof as recited in claim 1, the openable roof further comprising first connecting means for connecting the movable roof means to the fixed roof means, and a first driving means for driving the movable roof means into motion, each of the first connecting means being disposed adjacent to the corresponding first track of the fixed roof means and the corresponding first arc-shaped edge of the movable roof means so as to allow the movement of the corresponding movable roof means.

12. An openable roof as recited in claim 5, the openable roof further comprising first connecting means for connecting the movable roof means to the fixed roof means, and a first driving means for driving the movable roof means into motion, each of the first connecting means being disposed adjacent to the corresponding first track of the fixed roof means and the corresponding first arc-shaped edge of the movable roof means so as the allow the movement of the corresponding movable roof means.

13. An openable roof as recited in claim 9, the openable roof further comprising second connectiong means each for connecting the second movable roof member to the first movable roof member and the fixed roof member, and a second driving means for driving the second movable roof means into motion, each of the second connection means being disposed adjacent to the corresponding second track of the first movable roof member, the corresponding support track of the fixed roof member, and the corresponding first arc-shaped edge of the second movable roof member, so as to allow the movement of the corresponding second movable roof member.

14. A structure comprising the openable roof as recited in claim 1.

15. A structure comprising the openable roof as recited in claim 3.

* * * * *